United States Patent [19]

Szasz et al.

[11] 4,375,895

[45] Mar. 8, 1983

[54] SKI BRAKE

[75] Inventors: Tibor Szasz, Vienna; Kurt Liedl, Petronell, both of Austria

[73] Assignee: TMC Corporation, Baar, Switzerland

[21] Appl. No.: 202,215

[22] Filed: Oct. 30, 1980

[30] Foreign Application Priority Data

Nov. 16, 1979 [AT] Austria ..... 7311/79

[51] Int. Cl.[3] ..... A63C 7/10

[52] U.S. Cl. ..... 280/605

[58] Field of Search ..... 280/605, 604, 12 AB; 188/8

[56] References Cited

U.S. PATENT DOCUMENTS 4,123,083 10/1978 Riedel ..... 280/605

FOREIGN PATENT DOCUMENTS 324907 9/1975 Austria .
638773 3/1962 Canada .
2507371 9/1976 Fed. Rep. of Germany .
2900527 8/1979 Fed. Rep. of Germany .
2806643 8/1979 Fed. Rep. of Germany .
2902317 8/1979 Fed. Rep. of Germany .
2272695 4/1976 France .
2407726 6/1979 France ..... 280/605

*Primary Examiner*—Joseph F. Peters, Jr.
*Assistant Examiner*—Kenneth R. Rice
*Attorney, Agent, or Firm*—Flynn, Thiel, Boutell & Tanis

[57] ABSTRACT

A holding plate is secured on the top surface of a ski and pivotally supports a support frame. The support frame is a piece of wire material bent preferably into the shape of a square or an omega, the sections of which are preferably coplanar and at least one section of which serves as the pivot axle therefor. A torsion spring encircles said one section of the frame, has two legs with eyelets which respectively grip adjacent sections of the frame, and has a central section which rests against the holding plate. An operating pedal is releasably mounted on the support frame by resilient fastening clamps fabricated from the material of the operating pedal, at least one fastening clamp being engaged with each section of the support frame other than the section serving as the pivot axle. A pair of braking arms is pivotally supported in the pedal, and the pedal is pivotally movable between a braking position in which the free ends of the braking arms extend downwardly below the bottom of the ski and a retracted position in which such free ends are positioned above the top surface of the ski.

5 Claims, 4 Drawing Figures

SKI BRAKE

FIELD OF THE INVENTION

The invention relates to a ski brake having a braking mechanism which has two braking arms and has an operating pedal which supports the braking arms, the braking mechanism being supported pivotally about an axle, which axle is supported on a holding plate secured or fixed to the upper side of a ski and extends substantially at a right angle to the longitudinal axis of the ski, for movement against the force of preferably a torsion spring from a braking position into a retracted position, each braking arm being held (swung in) in the retracted position of the braking mechanism, by means of an operating plate and a braking arm extension which can be operated by said plate, above the upper side and inwardly of the two side surfaces of the ski, wherein after the operating pedal becomes free, for example after a fall or a stepping out of the ski binding, the two braking arms project below the running surface of the ski.

BACKGROUND OF THE INVENTION

A ski brake of the abovementioned type is described in German OS No. 29 00 527 (corresponds to U.S. Pat. No. 4,268,060), for example. In this conventional embodiment, the pedal is supported on the swivel axle for the braking mechanism, which swivel axle carries at the same time the erecting spring for the braking mechanism. Thus, the pedal is the support frame for the two braking arms and, consequently, special support is needed for the pedal on the swivel axle and also a separate swivel axle is needed for an operating plate which effects a swinging in and out of the two braking arms.

A similar brake is described in German OS No. 29 02 317 (also corresponds to U.S. Pat. No. 4,268,060), in which the pedal also forms the support frame for the two braking arms and is also supported on the swivel axle, a spring-loaded operating plate which biases the two braking arms and effects their swinging in and out also being supported on the swivel axle of the braking mechanism. With this, the necessity for a separate swivel axle for the operating plate is cancelled, but both this end and the first-mentioned ski brake, due to their construction, are limited to use in connection with a predetermined ski width.

In a different embodiment according to U.S. Pat. No. 3,715,126 (FIGS. 7 to 9), the support frame for the two braking arms is designed as a housing which is pivotal about an axis which extends at a right angle to the longitudinal axis of the ski and is spring-loaded, the individual braking arms being formed like braking wings which, supported on shafts, can be swung in and out. The shafts extend parallel to the longitudinal axis of the ski and form parts of an operating pedal. The two braking wings are thereby constructed at their regions which extend into the housing as operating extensions, wherein each operating extension cooperates with a counterpiece of the housing so that, in the retracted position of the braking mechanism, each wing will lie above the upper side of the ski and inwardly of the associated side surface of the ski. It is disadvantageous in this embodiment that a base and a wedgelike operating element must be provided on the upper side of the ski for each braking wing to provide on the one hand a secure support for the braking wing—and thus of the entire braking mechanism which lies in the retracted position—and to provide on the other hand a component which in the first phase of the swivelling of the braking mechanism from its retracted position into the braking position effects a sliding out of the individual braking wings. Only in this manner it is possible to avoid the problem of the braking mechanism remaining seated on the upper side of the ski. Aside from the mentioned disadvantages, a further disadvantage of the conventional construction consists in the housing having to rest in the braking position of the ski brake with its entire surface, which surface is disposed in the retracted position of the braking mechanism approximately vertical with respect to the upper side of the ski, on the upper side of the ski. This means that, for stepping in, the pedal defines an angle of 90° with the upper side of the ski, through which an automatic stepping in is practically impossible with this ski brake. In addition, the housing is built up relatively high, such that this ski brake can be positioned only in front of or behind the ski bindings on the upper side of the ski, and by no means between the two jaws of the ski binding. But in the case of ski brakes which are common today, placement between the two jaw parts of the ski binding is desirable. According to experience, an automatic stepping in is easiest when a ski binding is equipped with a ski brake in such an arrangement.

To complete the state of the art, the following references are pointed out but have a common disadvantage, in that the braking arms in the retracted position of the braking mechanism do not lie inwardly of the two side edges of the ski, namely, they cannot be swung in and out. The references which follow have characteristics, however, which are utilized in the subject matter of the invention.

From Austrian Pat. No. 324 907, it is already known to use as a brake a U-shaped bar which consists of a round wire and has a swivel axle which extends at a right angle with respect to the longitudinal axis of the ski, on each side of which axle there is arranged a leg spring, the ends of which spring are arranged on the one hand on a ski-fixed holding plate which also supports the swivel axle of the braking mechanism and on the other hand resting on one of the bar legs.

German OS No. 25 07 371 describes, in connection with FIG. 9, a ski brake in which the support frame consists of a bent spring wire which is equipped with at least one leg, the end of the leg being bent outwardly or inwardly and furthermore out of the plane of the bent spring wire or the leg, namely, bent twice, wherein at least one part of the bend is supported in a mounting which is secured on the upper surface of the ski. A disadvantage of this conventional embodiment is that the bends which are held in groovelike guideways permit a torsion only in the bent areas of the spring wire, through which sufficient elasticity is provided only by a relatively thin wire which does not have the stiffness needed in ski brakes, whereas tests have shown that a suitably strong wire cannot produce the necessary elasticity.

French OS No. 2 272 695 is mentioned only to be complete, since FIG. 12 thereof corresponds to FIG. 9 of the lastmentioned German OS.

In a different conventional ski brake according to Canadian Pat. No. 638 773, the two braking arms are constructed as parts of an operating pedal which can be fastened on the upper side of the ski by means of a hinge, the two hinge parts being biased by a torsion spring. The pedal is riveted to one of the hinge parts and the other hinge part is secured to the upper side of the ski, the one hinge part being biased by the two free ends of the torsion spring and the other hinge part by a loop which is formed approximately in the center of the spring.

In a still further ski brake, which is shown and briefly described on pages 10 and 11 of the 1979/80 Marker catalogue, the two braking arms are constructed as legs of a spring wire which is approximately U-shaped in the top view, the bight of the U-shaped formation being supported in a bearing plate which extends, in the retracted position of the ski brake, approximately parallel to the rotary table of the ski binding. The braking mechanism of the ski brake is biased by a divided helical spring. The two braking arms each extend through an eyelet of the mounting of the ski binding in order to create a connection between the ski binding and the ski brake. The ski brake is therefore usable exclusively in connection with a particular ski binding.

A ski brake having a braking bar which is connected to the two braking arms and which has, viewed in the front view, an approximately omega-shaped design is described in German OS No. 28 06 643. In this embodiment, one arm of the bar is, viewed in the longitudinal direction of the ski, constructed offset and the braking bar is biased by two C-shaped springs which, viewed in the longitudinal direction of the ski, are supported at a distance from the two bearing points of the braking bar on the upper side of the ski.

A similar ski brake which has been known on the market for a longer period of time is shown, for example, in the 1979/80 Look catalogue (page 11). The braking bar in this case is designed to lie in a plane and a substantially O-shaped spring is used as an erecting spring.

In the two lastmentioned solutions, the braking bar has, viewed in the front view and in the braking position of the braking mechanism, an approximately omega-shaped swivel and operating part on which the two braking arms are connected. This ski brake is also limited to the ski width for which it was produced, since an arbitrary spreading or compressing of the two bearing legs of the swivel and operating part of the braking mechanism, which bearing legs form the swivel axle of the braking mechanism, would fail, in that the two bearing legs could no longer be supported extending parallel to the upper side of the ski.

The basic purpose of the invention is to provide a simple ski brake of the abovementioned type which is as friction-free as possible during swivelling. Furthermore, the ski brake is to be adjustable in a so-called building-parts system for different width skis.

SUMMARY OF THE INVENTION

The set purpose is attained inventively by a braking mechanism which is supported on the holding plate by the interpositioning of a support frame constructed of a multiply bent wire, for example spring wire, of which one or two individual sections form the swivel or bearing axle for the support frame in the holding plate, the individual adjoining sections (wire legs) of the wire, possibly by leaving a space between two adjacent sections, being connected to the wire section(s) which form the swivel or bearing axle and, viewed in the front view, forming approximately a square or a large omega; wherein the support frame of the ski brake is developed to lie in a plane; wherein the swivel spring of the braking mechanism is supported in a conventional manner with its central looplike portion on the holding plate of the ski brake and its two free ends are constructed eyeletlike in a conventional manner and each, viewed in the braking position of the braking mechanism, clamps around a respective upwardly projecting leg of the support frame or is held supported on same; and wherein the operating pedal is releasably affixed to and nonmovable with respect to the support frame.

The inventive ski brake is conceivably simple, because the support frame itself forms the swivel axle for the braking mechanism of the ski brake and because the support frame permits the use of various types of constructions of pedals and braking arms. In particular, pedals of different dimensions can be mounted on the support frame, so that the ski brake can be used with different width skis. It is therefore sufficient if just pedal parts are manufactured with different dimensions, which reduces manufacturing expenses and inventory. Undesirably high friction forces during swivelling of the braking mechanism from the braking position into the retracted position and vice versa are not created; the design of the torsion spring permits the designer to choose a suitable spring characteristic for any type of use (children, teenagers, adults, racers).

A particularly advantageous embodiment of the invention consists in the operating pedal having on its surface area which faces the support frame resilient fastening clamps which, when the operating pedal is mounted on the support frame, releasably grips individual wire sections of the support frame, a fastening clamp of the operating pedal preferably being associated with each wire leg which extends upwardly in the braking position of the ski brake and with the wire section of the support frame which connects the two wire legs. In this manner, mounting of the pedal and possibly also an exchange of the pedal can be effected in a particularly simple manner.

For manufacturing reasons, it is particularly advantageous if the individual fastening clamps are inventively constructed of the material of the operating pedal.

It is furthermore advantageous to arrange the pedal on a support frame which is itself reinforced. In this case, it is provided that the connection between the operating plate and the support frame is inventively reinforced by at least one clamp or the like which being provided in the transition area between the two side wire legs and the two wire sections which form the swivel axle.

BRIEF DESCRIPTION OF THE DRAWINGS

Further characteristics, advantages and details of the invention will now be described in greater detail in connection with the drawings, which illustrate two exemplary embodiments.

In the drawings.

DETAILED DESCRIPTION

The braking mechanism is, both in the preceding and in the following description, the portion of the ski brake which moves during the swivelling from the retracted position into the braking position and vice versa, and thus determines the ineffective and effective positions of the ski brake. Structural parts which serve similar purposes in the two embodiments illustrated but are designed differently have been identified in the second embodiment with a prime (').

Figure 1:
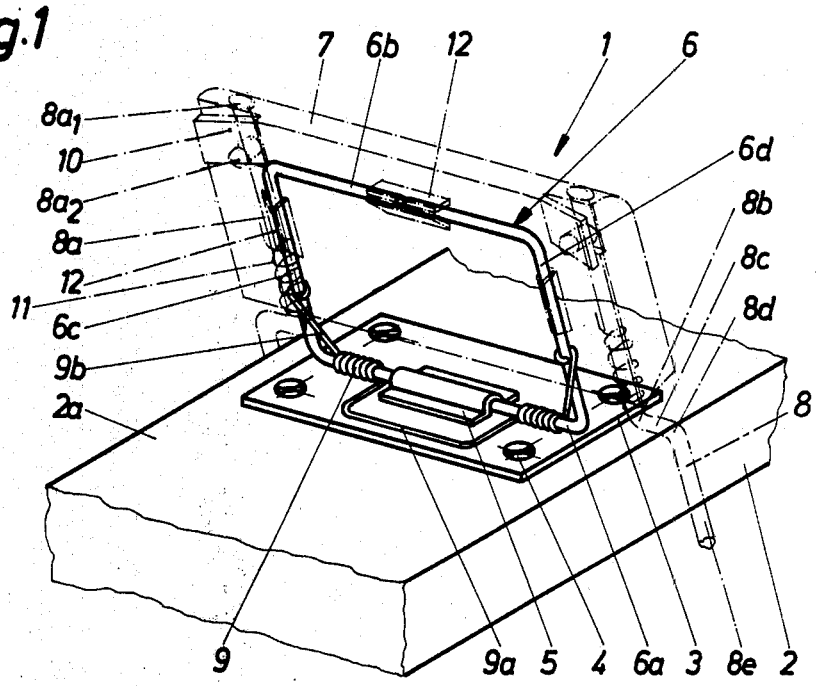
FIG. 1 is an oblique view of a first embodiment of the invention having a square support frame, the pedal and braking mandrels being indicated only in outline by broken lines.

A ski brake which is identified as a whole by reference numeral 1 has, according to FIG. 1, a holding plate 3 which is secured on the upper side 2*a* of a ski 2. In the present exemplary embodiment, the holding plate 3 is secured by means of screws 4 on the upper side of the ski. It is also conceivable to design the holding plate 3, as is actually known, to have a U-shaped cross section and to be adjustable on a rail extending in the direction of the longitudinal axis of the ski 2, so that the holding plate 3 of the ski brake 1 and a ski binding which is here not illustrated can suitably be adjusted to different sizes of ski shoe soles. This conventional measure does not itself form the subject matter of the invention, but has only been mentioned to show that the inventive ski brake is also suited for such use.

The holding plate 3 carries a bearing 5 which could, for example, by an upwardly bent portion of the material of the holding plate 3 or, as in FIG. 1 could be a separate member secured on the upper side of the holding plate 3, for example by screwing, riveting or welding. The details of the fastening of the bearing 5 in FIG. 1 are not shown.

Figure 2:
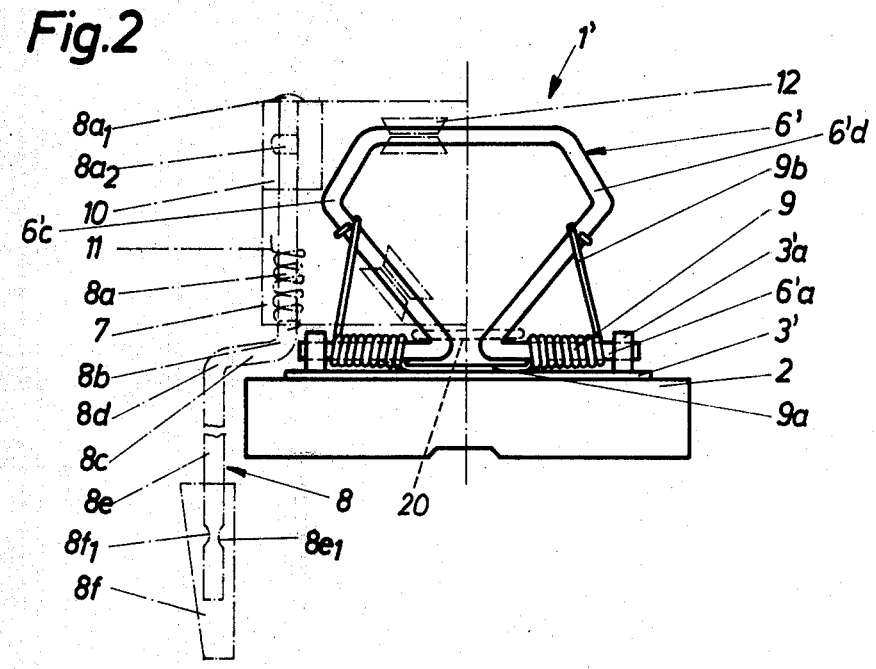
FIGS. 2 to 4 illustrate a second exemplary embodiment of the invention, FIG. 2 being a front view illustrating the ski brake in the braking position, only half the pedal and braking arms being indicated by broken lines, FIG. 3 being a side view of FIG. 2 with the pedal indicated in broken lines and FIG. 4 illustrating a detail of FIG. 2.

A support frame 6 is supported in the bearing 5 by means of a section 6*a* which extends at a right angle to the longitudinal axis of the ski 2. The support frame 6 has, in the front view, an approximately square design, whereby the section 6*b* which extends parallel to the section 6*a* and the two legs 6*c* and 6*d* carry a pedal 7 having braking arms 8, the pedal and braking arms being only indicated by broken lines. Each braking arm 8 is pivotally supported in the pedal 7 by means of a first wire section 8*a*, as is known by itself. The end of each braking arm 8 which projects beyond the pedal 7 is secured against an unintended movement in the direction of the longitudinal axis of the braking arm 8 by a rivet head 8*a*. Each braking arm 8 has at the other end, which end exits the pedal 7 at the pedal end area adjacent the swivel axle of the braking mechanism, a first bend 8*b* which is connected to a second wire section 8*c* which, viewed in the braking position of the ski brake, points toward a side surface of the ski and ends approximately at the side edge of the ski 2. A second bend 8*d* is provided at the other end of the second wire section 8*c* and passes over into a third wire section 8*e* which, viewed in the braking position of the ski brake, extends below the running surface of the ski 2, is constructed as a braking mandrel and carries a braking wing on its free end which is similar to the wing 8*f* in FIG. 2. The braking wing 8*f* of FIG. 2 is constructed in the form of a plastic coating and is held nonrotatably and secured against loss on the third wire section 8*e* by means of two shoulder parts $8f_1$ received in congruently constructed recesses $8e_1$ of the braking mandrel 8*e*. If necessary, the braking wing 8*f* can be removed by a man skilled in the art and can be replaced with a braking wing having different dimensions. Such a change is required for different snow conditions, for example, such as an icy slope or deep snow. Such measures are known by themselves and do not form the subject matter of the present invention.

A spring 9 (FIG. 1) which effects the erecting of the braking mechanism of the ski brake 1 is constructed as a torsion spring which encircles two areas of the section 6*a* of the support frame 6 which serves as a swivel brake, has a central looplike portion 9*a* supported on the upper side of the holding plate 3, and slidably encircles at each of its two free ends a respective leg 6*c* or 6*d* of the support frame 6, so that upon a swivelling of the support frame 6 by means of the pedal 7 through forces applied by a not illustrated ski shoe, the spring 9 is initially tensioned and the two braking arms 8 are pivoted through extensions $8a_2$ which are provided on the first wire sections 8*a* by means of springy or elastically flexible plates 10 into positions in which each third wire section 8*e* lies spaced above the upper side of the ski 2*a* and inwardly of the associated side surface of the ski 2. During a release of the ski shoe through a fall of the skier or during a voluntary stepping out of the ski binding, the spring 9 urges the braking mechanism into the braking position, and the now free springy or elastically flexible plates 10 each release an associated braking arm 8 which is then moved into the swung-out position, for example through the action of springs 11. Such a swinging in or out of the braking mandrels 8 is known by itself. In the present exemplary embodiment, the loop-like portion 9*a* of the spring 9 partially surrounds the bearing 5 of the support frame 6.

The fastening of the pedal 7 of FIG. 1 on the support frame 6 is similar to that discussed in greater detail hereinbelow in connection with the second exemplary embodiment.

Figure 3:
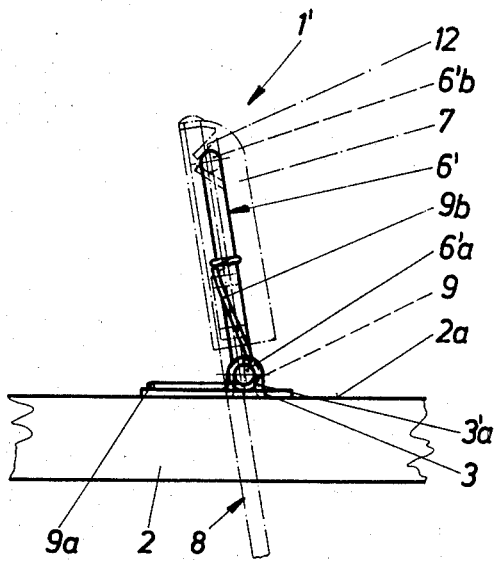
Figure 4:
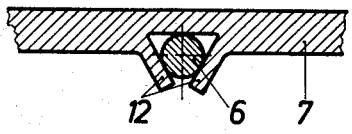

In the second exemplary embodiment, illustrated in FIGS. 2 to 4, the support frame 6' of the ski brake 1', viewed from the front, is constructed approximately omega-shaped, the swivel axle here being formed by two sections 6'*a* of the support frame 6' which are aligned with one another and are supported in two bearings 3'*a* which are upwardly bent portions of the holding plate 3'. The pedal 7 and the individual braking mandrels 8 of FIG. 2 correspond substantially with the first exemplary embodiment according to FIG. 1, except for a slight change in the connecting pieces on the pedal 7 due to the construction. This difference on the underside of the pedal 7, which difference is due only to the form, was not considered for the sake of simplicity.

Also left unconsidered is the structure of the spring 9 with its two free ends 9*b* which is slightly different than in the first exemplary embodiment.

To fasten the pedal 7 or the like on the individual wire sections of the support frame 6 or 6', the pedal 7 has on its underside elastically flexible fastening clamps 12 into which the wire sections of the support frames 6 or 6' can be inserted. After mounting the pedal 7, the latter is held securely to the support frame 6 or 6', in the first exemplary embodiment at three locations and in the second exemplary embodiment at four locations. Since an operational force applied to the pedal 7 occurs in the direction of the section 6*a* of the support frame 6 which is designed as a swivel axle, it is unimportant that the pedal 7 is held against movement in the direction away from the support frame 6 only by the elastic clamps 12. This elasticity is namely intended so that the mounting of the pedal 7 on the support frame 6 occurs with a rather high force, which force practically never occurs when the ski brake 1 is used in the opposite direction. The structure of a fastening clamp 12 is shown in detail in FIG. 4.

FIG. 4 and also FIG. 3, which both show the ski brake 1 in a side view, can be utilized for discussion of both exemplary embodiments.

The invention is not limited to the exemplary embodiments illustrated. Further modifications are conceivable without leaving the scope of the invention. It has already been indicated that there exist no limitations with respect to the use of the pedal with two braking arms, with the condition that a pedal or the like can be connected at all to the support frame. One can also provide a support frame having a groove which substantially corresponds with the free-standing circumference of the support frame and in which the support frame can be inserted, the pedal being covered on its underside with a flat cover plate which can be screwed to the underside of the pedal. In this case, the fastening clamps are not needed.

In a further modification, the two aligned sections of the second exemplary embodiment are connected with one another by means of a separate clamp for example, the clamp 20 shown in FIG. 2 in broken lines. The pedal is relieved from the load in this area by this modified embodiment.

In a still further embodiment, the area of the section of the support frame which extends into the bearing is supported to act as a torsion spring. Through this, the erecting effect of the erecting spring can be supplemented.

The embodiments of the invention in which an exclusive property or privilege is claimed are defined as follows:

1. In a ski brake having a braking mechanism which has two braking arms and an operating pedal means which supports said braking arms, said braking mechanism being supported pivotally by a pivot axle means mounted on a holding plate adapted to be secured to the upper side of a ski, said pivot axle means supporting said braking mechanism for movement about an axis which extends substantially at a right angle with respect to the longitudinal axis of said ski, said braking mechanism being pivotal about said axis against the force of an erecting spring from a braking position into a retracted position, each braking arm being maintained in the retracted position of the braking mechanism above the upper side and inwardly of the two side surfaces of the ski by a force applied to an operating plate part of said operating pedal means and a braking arm extension operable by said operating plate, wherein after the operating pedal means becomes free, for example after a fall or a stepping out of the ski binding, the two braking arms project below the running surface of the ski, the improvement comprising wherein the braking mechanism is supported on the holding plate by interpositioning a support frame which is constructed of a multiply bent spring wire of which at least one individual section forms said pivot axle means for said support frame on said holding plate, the individual adjoining sections of the wire forming said support frame being connected to the wire section(s) which forms said pivot axle means, said adjoining sections forming at least one of an approximate square and an omega; wherein the sections of wire forming said support frame are coplanar and remain coplanar throughout the range of movement of said ski brake; and wherein connecting means are provided for releasably connecting said operating plate to said support frame, said releasable connection effecting a fixed positioning of said operating plate on said support frame.

2. The ski brake according to claim 1, wherein the region of said operating plate facing said support frame has resilient fastening clamps thereon for releasably securing said operating pedal to the individual wire sections of said support frame, at least one of said fastening clamps being operatively connected to each leg of said adjoining sections of the support frame.

3. The ski brake according to claim 2, wherein the fastening clamps are constructed of the material of the operating pedal.

4. The ski brake according to claim 1, wherein the connection between said operating plate and said support frame is reinforced by at least one fastening clamp engaging the region between each of two wire sections which form said pivot axle means and each of at least two wire legs of said adjoining sections.

5. The ski brake according to claim 1, wherein said erecting spring has a central looplike portion mounted on said holding plate and two free ends which each slidably encircle a respective upwardly projecting leg of said adjoining sections of said support frame.

* * * * *